US007736467B2

(12) United States Patent
Nykanen et al.

(10) Patent No.: US 7,736,467 B2
(45) Date of Patent: Jun. 15, 2010

(54) SCREEN ASSEMBLY FOR A PULP DIGESTER

(75) Inventors: Tuomo Nykanen, Duluth, GA (US); Lasse Hernesniemi, Pietarsaari (FI)

(73) Assignee: Metso Paper Pori Oy (FI)

( * ) Notice: Subject to any disclaimer, the term of this patent is extended or adjusted under 35 U.S.C. 154(b) by 1357 days.

(21) Appl. No.: 11/011,520

(22) Filed: Dec. 14, 2004

(65) Prior Publication Data

US 2005/0284594 A1 Dec. 29, 2005

Related U.S. Application Data

(60) Provisional application No. 60/583,885, filed on Jun. 29, 2004.

(51) Int. Cl.
*D21C 7/00* (2006.01)

(52) U.S. Cl. ..... 162/251; 162/233; 162/237; 162/248; 422/217; 422/187; 210/498; 210/499; 210/357

(58) Field of Classification Search ..... 162/251, 162/233, 55, 237, 248; 422/217, 187; 210/498, 210/499, 357, 391, 155, 158
See application file for complete search history.

(56) References Cited

U.S. PATENT DOCUMENTS 1,487,004 A * 3/1924 Allen ..... 162/251
5,985,096 A 11/1999 Marcoccia et al.
6,129,816 A 10/2000 Sheerer et al.
6,312,590 B1 11/2001 Isola
6,375,796 B1 4/2002 Sheerer et al.
2003/0095901 A1 5/2003 Isola

FOREIGN PATENT DOCUMENTS

WO WO 01/31117 5/2001

* cited by examiner

*Primary Examiner*—Mark Halpern
(74) *Attorney, Agent, or Firm*—Lerner, David, Littenberg, Krumholz & Mentlik, LLP

(57) ABSTRACT

A pulp digester includes a vessel having an inlet, an outlet and a wall extending between the inlet and the outlet, the wall of the vessel having a curved interior surface. The digester includes a screen assembly positioned inside the vessel adjacent to the curved interior surface of the wall for removing liquid from pulp material. The screen assembly is movable relative to the curved interior surface of the vessel wall. The digester includes at least one support element permanently attached to the vessel wall for limiting movement of the screen assembly relative to the curved interior surface of the vessel wall. In certain embodiments, the at least one support, such as a ledge permanently attached to the vessel wall, supports a portion of the screen assembly. The screen assembly may have an inner face that is concave in a horizontal direction and convex in a vertical direction.

8 Claims, 6 Drawing Sheets

RELATIVE CHIP COLUMN COMPACTION

SCREEN ASSEMBLY FOR A PULP DIGESTER

CROSS REFERENCE TO RELATED APPLICATIONS

This application claims the benefit of the filing date of U.S. Provisional Patent Application No. 60/583,885, filed Jun. 29, 2004, the disclosure of which is hereby incorporated herein by reference.

BACKGROUND OF THE INVENTION

The present application is generally directed to making pulp and is more specifically directed to screen assemblies for pulp digesters.

Continuous digesters are used in the paper and pulp industry to remove lignin from wood chips. The digesters generally include a series of tubular reactors that are arranged in a vertical orientation. The digester is made up of a plurality of reaction and extraction stages for carrying out the pulp-making process in a specific sequence. In certain stages, chemicals are introduced into the digester for chemically treating the woodchips. These chemicals may include hydrosulfide and sodium hydroxide, commonly referred to as liquor. In other stages, the chemicals are removed from the reactor through screens provided inside the digester.

FIGS. 1A and 1B show a conventional pulp digester 20 having a vessel wall 22 with an interior surface 24 and an exterior surface 26. The vessel 22 has a step out section 28 and a straight section 30 located below the step out section. The step out section 28 diverges outwardly for expanding the diameter of the vessel 22 between an upstream section of the digester and a downstream section of the digester.

The digester 20 includes a bar screen 32 having an upper end 34 and a lower end 36. The bar screen 32 includes a plurality of vertically extending, cylindrical bars 38 that are spaced from one another. The upper end 34 of the bar screen 32 is attached to the vessel via an upper support element 40 and the lower end 36 of the bar screen 32 is attached to the vessel via a lower support element 42. The bar screen is permanently fixed to the vessel wall 22, such as by welding the upper and lower ends 34, 36 of the bar screen 32 to the upper and lower support elements 40, 42. The bar screen 32 has a diameter that remains substantially constant between the upper and lower ends 34, 36 thereof.

The digester also includes an upper cover plate 44 having an upper end 46 and a lower end 48. The upper end 46 of the upper cover plate 44 is secured to the interior surface 24 of the vessel at a location above the step out section 28. The lower end 48 of the upper cover plate 44 is secured to the upper support element 40. The digester also has a lower cover plate 50 having an upper end attached to lower support element 42. The lower cover plate 50 extends downwardly from the bar screen 32 to a downstream section (not shown) of the digester. The digester has an outlet 52 for removing liquid from the vessel.

Permanently fixing the bar screen to the wall 22 involves a significant amount of work when assembling the digester. For example, when welding is used, the manufacturing process requires hundreds of welds to attach one bar screen to the vessel wall. For a vessel having many bar screens, the number of required welds may be in the thousands. The large number of welds increases the chances that one or more of the welds will crack, which may adversely affect operation of The digester or may require the digester to be taken off-line for repairs.

The production of quality pulp involves introducing and removing liquor from the digester at certain time periods. The liquor is typically removed from digesters by passing the liquor through screens in a radial direction. The radial removal of the liquor causes compression of the wood chips onto the screen. This may prevent the wood chips from continuing to move toward the bottom of the digester, which is critical for the proper treatment of the chips. Extreme radial compression may also limit the amount of liquor that can be removed from the digester. Both of these situations may adversely affect the quality of the pulp produced using the digester.

FIGS. 2A and 2B show a pulp digester having a diverging screen assembly. The digester 120 has a vessel wall 122 with an interior surface 124 and an exterior surface 126. The vessel 122 has a step out section 128 and a straight section 130 located below the step out section. The step out section 128 diverges outwardly for expanding the diameter of the vessel 122 between an upstream stage and a downstream stage of the digester.

The digester 120 includes a diverging bar screen 132 having an upper end 134 and a lower end 136. The bar screen 132 includes a plurality of vertically extending, cylindrical bars 138 that are spaced from one another. The upper end 134 of the bar screen 132 is attached to the vessel via an upper support element 140 and the lower end 136 of the bar screen 132 is attached to the vessel via a lower support element 142. The bar screen continuously diverges between upper and lower ends thereof for reducing the compression loading of the wood chips on the screen. The digester also includes an upper cover plate 144 having an upper end 146 and a lower end 148. The upper end 146 of the upper cover plate 144 is secured to the interior surface 124 of the vessel at a location above the step out section 128. The lower end 148 of the upper cover plate 144 is secured to the upper support element 140. The digester also has a lower cover plate 150 having an upper end attached to lower support element 142. The lower cover plate 150 extends downwardly from the bar screen 132 to another downstream stage (not shown) of the digester. The digester has an outlet 152 for removing liquid from the vessel.

In spite of the above advances, there is a need to provide continuous digesters that more efficiently introduce and remove liquor from the digester vessel at various stages of the pulp making process. There also remains a need for simplified methods for building digesters. Specifically, there remains a need for simpler methods for assembling screen assemblies inside digesters that minimize the number of welds needed for securing the screen inside the digester. Further, there remains a need for screen assemblies that are less subject to breakage during digester operations.

SUMMARY OF THE INVENTION

In certain preferred embodiments of the present invention, a pulp digester includes a vessel having an inlet, an outlet and a wall extending between the inlet and the outlet, the wall of the vessel having a curved interior surface. The digester preferably includes a screen assembly positioned inside the vessel adjacent to the curved interior surface for removing liquid from pulp material. The screen assembly is desirably movable relative to the curved interior surface of the vessel wall. The digester also preferably includes at least one support element permanently attached to the vessel wall for limiting movement of the screen assembly relative to the curved interior surface of the vessel wall.

The at least one support element preferably supports a portion of the screen assembly. In certain preferred embodiments, the at least one support element supports a lower portion of the screen assembly. The at least one support element may include a ledge immovably attached to the vessel wall. The ledge may be welded to the vessel wall.

The at least one support element may also include at least one cover plate overlying the interior surface of the wall and being permanently attached to the wall, with the at least one cover plate being in contact with the screen assembly for limiting movement of the screen assembly over the curved interior surface of the vessel wall. In certain preferred embodiments, the at least one cover plate desirably includes an upper cover plate in contact with an upper end of the screen assembly and a lower cover plate in contact with a lower end of the screen assembly, the cover plates being permanently attached to the wall.

The at least one cover plate is preferably in contact with the screen assembly for limiting movement of the screen assembly relative to the curved interior surface of the vessel wall. The upper cover plate may diverge in a flow direction of the pulp material through the vessel. The digester may also include a pair of lateral cover plates in contact with respective sides of the screen assembly, the lateral cover plates extending between the upper and lower ends of the screen assembly and being permanently attached to the wall.

Although the present invention is not limited by any particular theory of operation, it is believed that providing screen assemblies that are movable relative to the vessel wall will solve a number of problems associated with digesters. First, the movable screen assembly of the present invention can better accommodate pressure changes within the vessel because the screen assembly can move in response to high-pressure areas within the vessel. Thus, the movable screen of the present invention enables pressure to be more evenly distributed throughout the vessel. Second, the ability of the screen assemblies of the present invention to move tends to minimize the formation of cracks in either the screen assembly or the welds used to position the screen assembly within the vessel. This feature overcomes problems found in prior art digesters that use thousands of welds to hold screens in place. These welds tend to crack under pressure or during long-term use, which results in maintenance problems or downtime for the digester. Third, the movable screen assemblies of the present invention can be used in a wide variety of digesters having different inner wall surfaces. As is well known to those skilled in the art, no two digesters are the same. This often makes it difficult to weld prior art screens to the vessel wall. However, this problem of matching the contour of the screen to the contour of the vessel wall is solved with the present invention because the screen floats and/or is movable relative to the vessel wall, thereby minimizing the need for providing exacting tolerances between the contour of the screen assembly and the contour of the vessel wall. The present invention also enables digesters to be assembled in less time and at lower cost. This is due, in part, to the fact that fewer welds are required for positioning the screens within a vessel. In many instances, the number of fewer welds may be in the hundreds or thousands.

In certain preferred embodiments of the present invention, the screen assemblies may be used to replace existing screens in a digester. In certain embodiments, the existing screen assemblies in a digester may be cut out and/or removed from the digester and replaced with one or more screen assemblies of the present invention. The newly installed one or more screen assemblies of the present invention may be held in place by cover plates that overlie the one or more edges of the screen assembly. The screen assembly of the present invention is preferably moveable relative to the vessel wall of the digester. As a result, the screen assembly is able to respond to high pressure areas within the digester. In certain preferred embodiments, the screen assemblies of the present invention are assembled outside of the digester. The screen assemblies are then secured inside the digesters in a manner so that the screen assemblies are moveable within a range or area relative to the vessel wall. Due to the moveable nature of the screen assemblies of the present invention, exact tolerances between the outer face of the screen assembly and the inner face of the vessel wall are not required.

In certain preferred embodiments, the screen assembly has an inner face that is concave in a horizontal direction. The screen assembly may also have an inner face that is convex in a vertical direction. In other preferred embodiments, the screen assembly may diverge in the flow direction of the pulp material.

The screen assembly desirably includes a plurality of bars extending in a generally vertical direction between the upper and lower ends of the screen assembly, whereby the bars are spaced from one another so as to define gaps between the spaced bars. In certain preferred embodiments, the bars are curved in the vertical direction. The size of the gaps between the spaced bars may remain constant between the upper and lower ends of the screen assembly. In other preferred embodiments, the size of the gaps between the spaced bars may change between the upper and lower ends of the screen assembly. In still other preferred embodiments, the vessel preferably has a longitudinal axis extending between upper and lower ends thereof and each of the bars of the screen assembly is curved relative to the longitudinal axis. The bars may be of any geometric shape in cross-section, such as cylindrical, circular, oval, square or rectangular. The exterior surface of the bars may be curved in one area and flat in another area.

In other preferred embodiments, the screen assembly may include one or more metal plates having one or more openings therethrough. The screen assembly may include a metal plate having a plurality of openings extending therethrough. The size and spacing of the openings may be constant or may change over the area of the plate. The openings may also be elongated in one or more directions such as slots. In further preferred embodiments, the screen assembly may include a plurality of metal plates that are assembled together with gaps or spaces between the metal plates. The size and shape of the gaps may be constant or may change.

In certain preferred embodiments, the screen assembly includes a top support arch, a bottom support arch spaced from the top support arch, and at least one intermediate support arch positioned between the top and bottom support arches. The screen assembly may also include at least one frame member attached to the support arches for maintaining the support arches in a fixed, spaced orientation relative to one another, and a plurality of spaced bars extending between the top and bottom support arches, the spaced bars having upper sections permanently attached to the top support arch, lower sections permanently attached to the bottom support arch and intermediate sections in contact with, but not permanently attached to, the at least one intermediate support arch.

The support arches may have inwardly extending fingers for engaging the bars. The fingers of the intermediate arch may be longer than the fingers of the top and bottom support arches for providing a curve to the bars between the top and bottom support arches. The screen assembly may include a plurality of intermediate support arches between the top and bottom support arches. The fingers of the intermediate arches near the center of the screen assembly are preferably longer than the fingers of the intermediate arches near the top and bottom support arches.

In other preferred embodiments of the present invention, a pulp digester includes a vessel having an inlet, an outlet and a wall extending between the inlet and the outlet, whereby the wall of the vessel has a curved interior surface. The digester may include a screen assembly for removing liquid from the pulp material, whereby the screen assembly has an inner face that is concave in a horizontal direction and convex in a vertical direction. In this embodiment, the screen assembly may be movable over the curved interior surface of the vessel wall, The digester further comprising at least one support element permanently attached to the vessel wall for limiting movement of the screen assembly over the curved interior surface of the vessel wall.

In other preferred embodiments of the present invention, a screen assembly for a pulp digester includes a top support arch, a bottom support arch spaced from the top support arch and at least one intermediate support arch positioned between the top and bottom support arches. The screen assembly desirably includes at least one frame member attached to the top support arch, the bottom support arch and the at least one intermediate support arch for maintaining the support arches is a fixed orientation relative to one another, and a plurality of spaced bars extending between the top and bottom support arches, the spaced bars having upper sections permanently attached to the top support arch, lower sections permanently attached to the bottom support arch and intermediate sections in contact with, but not permanently attached to, the at least one intermediate support arch. The bars are desirably curved between the upper and lower sections thereof.

In certain preferred embodiments, the screen assembly has an inner face that is concave in a horizontal direction. The inner face may be convex in a vertical direction.

Each of the support arches desirably has a convex outer face and a concave inner face having fingers that engage the respective bars. The fingers of the at least one intermediate support arch are preferably longer than the fingers of the top and bottom support arches for facilitating curving of the bars when the bars are in contact with the fingers. The inner ends of the fingers desirably have seating surfaces adapted to receive the bars. The bars have preferably have cylindrical exterior surfaces and the seating surfaces of said fingers are preferably concave for receiving the cylindrical exterior surfaces of the bars.

The support arches preferably extend in directions that are parallel to one another. At least one intermediate support arch preferably includes a plurality of intermediate support arches between the top support arch and the bottom support arch. The fingers of the intermediate support arches are progressively longer for the arches closer to the center of the screen assembly.

In another preferred embodiment of the present invention, a screen assembly for removing liquid from a pulp digester includes a top support arch having inwardly extending fingers, a bottom support arch spaced from the top support arch and having inwardly extending fingers, and at least one intermediate support arch positioned between the top and bottom support arches and having inwardly extending fingers. The screen assembly desirably includes at least one frame member attached to the top support arch, the bottom support arch and the at least one intermediate support arch for maintaining the support arches is a fixed orientation relative to one another, and a plurality of spaced bars extending between the top and bottom support arches, whereby each bar is in contact with one of the fingers of each support arch. The fingers of the at least one intermediate arch are preferably longer than the fingers of the top and bottom support arches for bending the bars between the top and bottom support arches.

The spaced bars may have upper sections permanently attached to the fingers of the top support arch, lower sections permanently attached to fingers of the bottom support arch and intermediate sections in contact with, but not permanently attached to, the fingers of the at least one intermediate support arch.

In other preferred embodiments of the present invention, a method of installing a screen assembly in a pulp digester includes providing a vessel having an inlet, an outlet and a wall extending between the inlet and the outlet, whereby the wall of the vessel has a curved interior surface. The method includes attaching a support element to the curved interior surface of the vessel wall, and installing a screen assembly inside the vessel adjacent the curved interior surface so that the screen assembly is movable relative to the curved interior surface, whereby the support element engages a portion of the screen assembly for limiting downward movement of the screen assembly through the vessel. The attaching step may include permanently securing the support element to the curved interior surface, such as by welding.

In another preferred embodiment of the present invention, a method of installing a screen assembly in a pulp digester includes providing a vessel having an inlet, an outlet and a wall extending between the inlet and the outlet, whereby the wall of the vessel has a curved interior surface, and installing a screen assembly inside the vessel adjacent the curved interior surface, the screen assembly having a horizontal cross-section that is concave and a vertical cross-section that is convex. The method may include attaching a support element to the curved interior surface of the vessel wall so that the screen assembly is movable relative to the curved interior surface, whereby the support element engages a portion of the screen assembly for limiting downward movement of the screen assembly through the vessel.

These and other preferred embodiments of the present invention will be described in more detail below.

DETAILED DESCRIPTION OF PREFERRED EMBODIMENTS

Figure 3A:
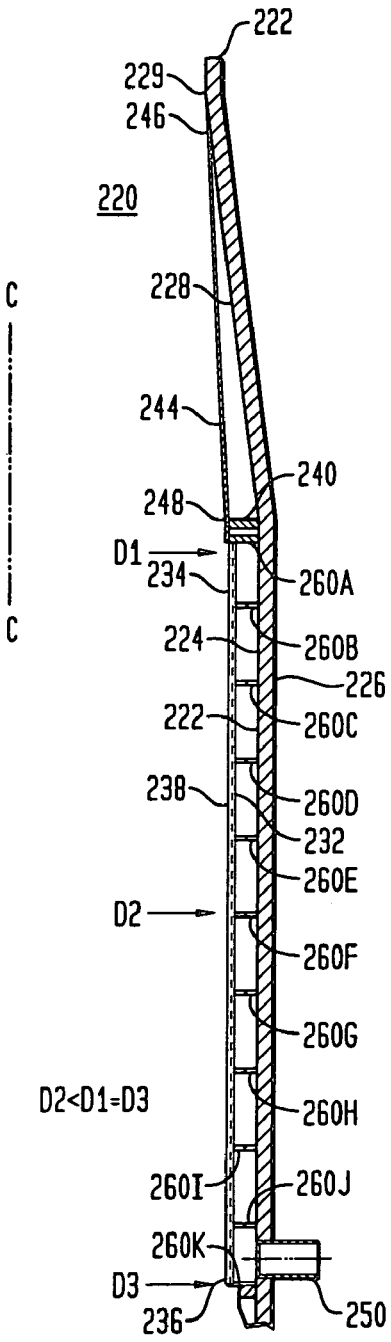
FIG. 3A shows a cross-sectional view of a pulp digester including a vessel and a screen positioned inside the vessel, in accordance with certain preferred embodiments of the present invention.
Figure 3B:
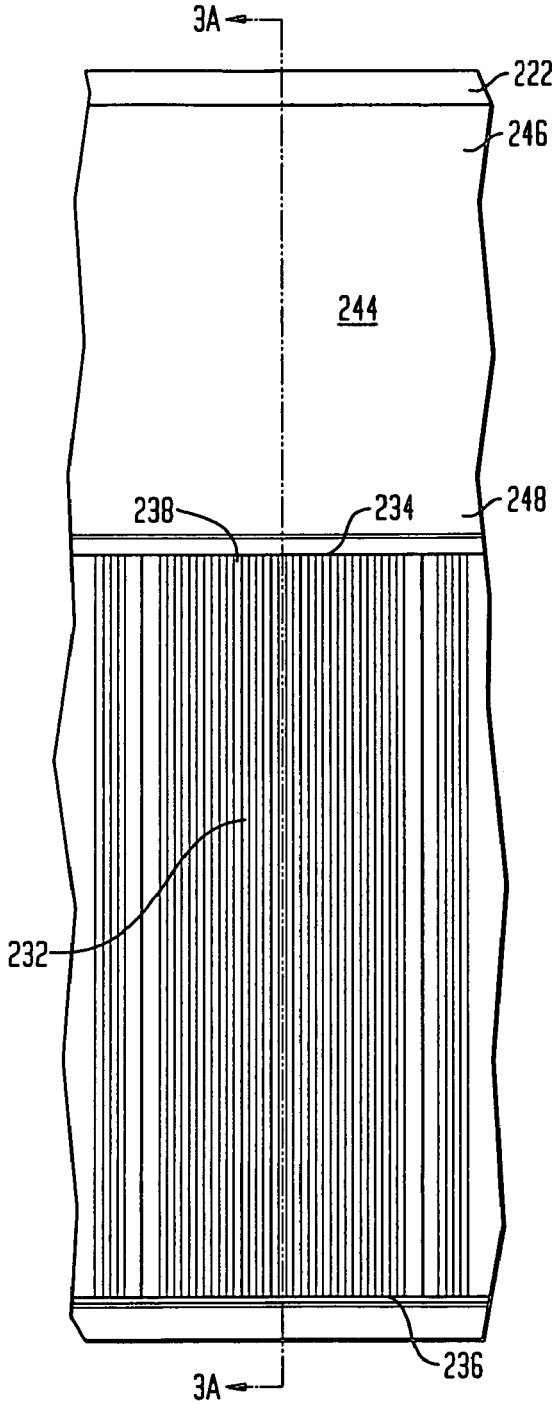
FIG. 3B shows a fragmentary front elevation view of the vessel and the screen shown in FIG. 3A.

FIGS. 3A and 3B show a pulp digester 220 in accordance with certain preferred embodiments of the present invention. The pulp digester 220 desirably includes a vessel wall 222 with an interior surface 224 facing the inside of the vessel and an exterior surface 226 facing the outside of the vessel. The vessel wall 222 has a step out section 228 that diverges outwardly from an upstream stage 229 of the digester. The vessel wall 222 also has a straight section 230 located below the step out section 228. The vessel wall 222 has a longitudinal axis or centerline C-C, and the step out section 228 diverges outwardly from the centerline C-C for expanding the interior diameter of the vessel wall 222 between the upstream stage 229 and a downstream stage.

Figure 4:
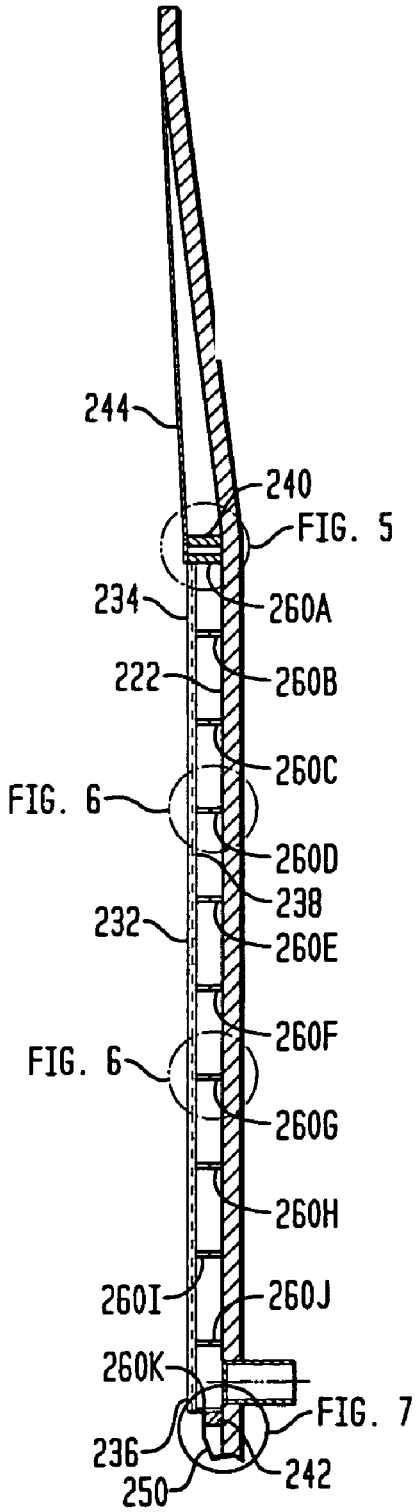
FIG. 4 shows another cross-sectional view of the pulp digester shown in FIG. 3A.

Referring to FIGS. 3A, 3B and 4, the digester 220 preferably includes a bar screen 232 having an upper end 234 and a lower end 236. The bar screen 232 desirably includes a plurality of vertically extending bars 238 that are spaced from one another. The bars 238 may be cylindrical in shape. The size of the gaps between the bars may be constant or may change over the area of the screen. The gaps between the bars 238 preferably allow fluid, such as liquor, to flow between the bars when treating pulp in the digester. The bar screen 232 preferably includes a series of support arches 260 that extend between the upper and lower ends of the screen.

In certain preferred embodiments, the upper end 234 of the bar screen 232 (FIG. 3A) may be located anywhere in the step out section 228 of the vessel wall 222, with the lower end 236 of the bar screen being supported by the lower support element 242.

Figure 5:
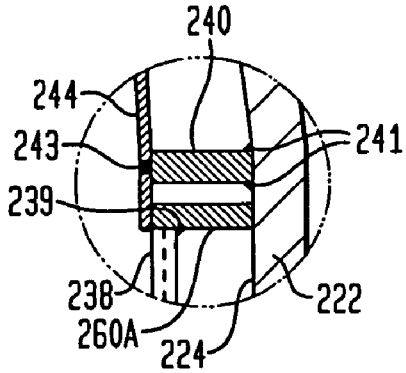
FIG. 5 shows an expanded view of an upper section of the screen shown in FIG. 4.
Figure 6:
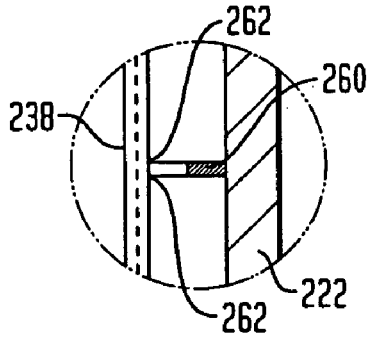
FIG. 6 shows an expanded view of an intermediate section of the screen shown in FIG. 4.
Figure 7:
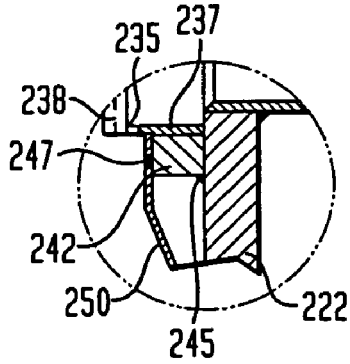
FIG. 7 shows an expanded view of a lower section of the screen shown in FIG. 4.

Referring to FIGS. 3A, 4 and 5, the uppermost end of bar screen 232 includes at least one bar 238 that is attached to a top support arch 260A by weld 239. Referring to FIGS. 4 and 7, the lowermost end 226 of bar screen 232 includes at least one bar 238 that is attached to a bottom support arch 260K by weld 235. Referring to FIGS. 4 and 6, bar screen 232 also has one or more intermediate support arches 260 between the top support arch 235 and the bottom support arch 237. In the particular preferred embodiment shown in FIG. 6, the round bar 238 is welded to intermediate support arch 260 by welding 262. This welding with an intermediate arch is generally done when the screen 232 has a substantial height. Welding and even the provision of the intermediate arch may not be necessary for screens that do not have substantial height. Thus, in other preferred embodiments, the bar 238 merely engages and/or is supported by the intermediate support arch 260 and is not attached to the intermediate support arch 260. Significantly, none of the support arches 260A-260K is attached to the vessel wall 222. As a result, the bar screen 232 is able to move relative to the vessel wall, within an area bordered by one or more supporting elements as will be described in more detail below.

Referring to FIGS. 3A, 3B, 4 and 5, the digester also preferably includes an upper cover plate 244 having an upper end 246 and a lower end 248. The upper end 246 of the upper cover plate 244 is secured to the interior surface 224 of the vessel wall 222 and the lower end 248 of the upper cover plate 244 is secured to an upper support element 240. The upper support element 240 has an outer end that is attached to the inner wall 224 of the vessel wall 222 and an inner end that is attached to the upper cover plate 244. Referring to FIGS. 4 and 5, the above-referenced attachments may be formed by attaching the outer end of the upper support element 240 to the interior surface 224 of vessel wall 222 using welding seams 241, and attaching the inner end of the upper support element 240 to the upper cover plate 244 using welding seam 243. The upper cover plate 244 preferably diverges outwardly from centerline C-C between the upper and lower ends of the upper cover plate. As a result, the distance between the centerline and the upper end of the upper cover plate is less than the distance between the centerline and the lower end of the upper cover plate.

Referring to FIGS. 3A, 4 and 7, the digester 220 also preferably has a lower cover plate 250 having an upper end attached to the lower support element 242 that is attached to the vessel wall 222. The lower cover plate 250 extends downwardly from the lower end 236 of bar screen 232 to a downstream stage (not shown) of the digester. Referring to FIGS. 4 and 7, the lower support element 242 has an outer end attached to vessel wall 222 by welding seam 245 and an inner end attached to lower cover plate 250 by welding seam 247.

As noted above, the support arches 260A-260K of the bar screen assembly 232 are not attached to the vessel wall 222, but are bounded by and held in position by the one or more supporting elements such as the upper and lower cover plates 244, 250, the upper support element 240 or the lower support element 242. As shown in FIGS. 4 and 5, the upper cover plate 244 covers or overlaps the top support arch 260A but is not attached thereto so that the upper end 234 of the bar screen is able to float freely in back of the upper cover plate. As shown in FIGS. 4 and 7, the lower cover plate 250 covers or overlaps the bottom support arch 260K but is not attached thereto so that the lower end 236 of the bar screen is able to float freely in back of the lower cover plate 250. The lower support element 242 preferably supports the lower end of the screen assembly 232 and limits downward movement of the screen assembly relative to the vessel wall.

Referring to FIGS. 3A and 4, the digester has at least one outlet 252 for removing fluid and/or liquid from the vessel wall 222.

Figure 8:
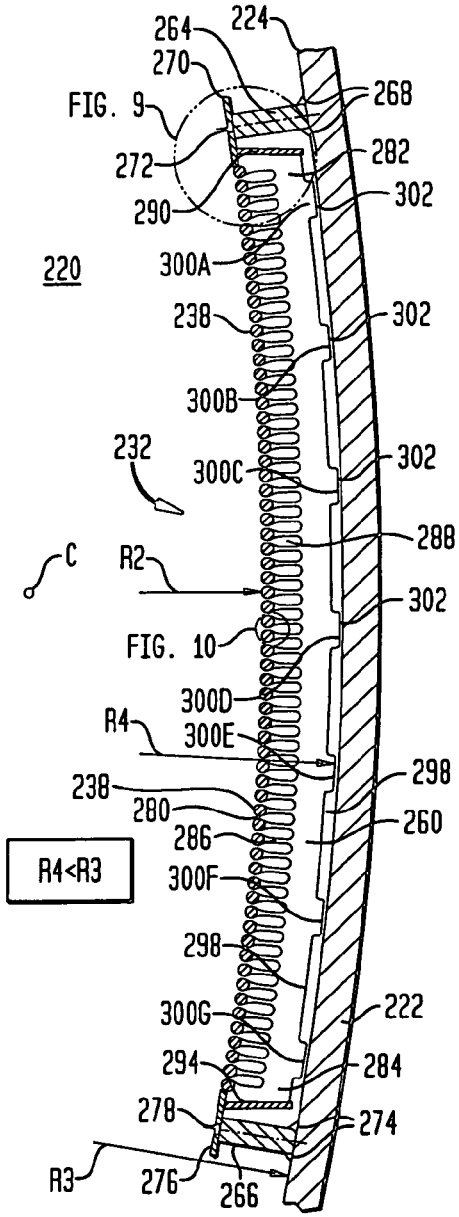
FIG. 8 shows a top plan view of a portion of the vessel and the screen shown in FIG. 4.
Figure 9:
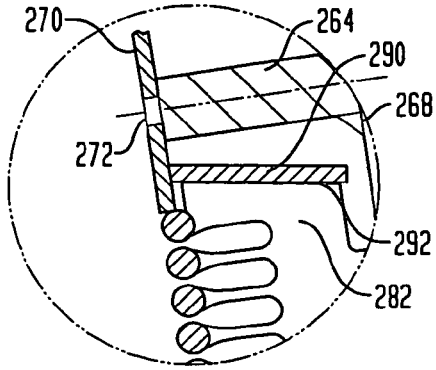
FIG. 9 shows an expanded view of a lateral section of the screen shown in FIG. 8.
Figure 10:
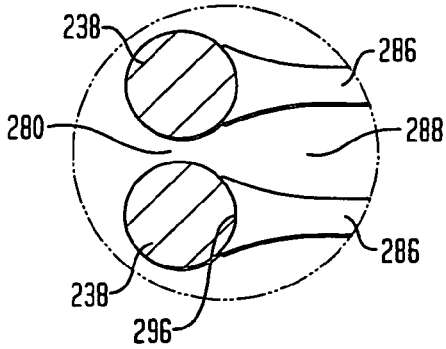
FIG. 10 shows an expanded view of an intermediate section of the screen shown in FIG. 8.

Referring to FIGS. 8-10, digester 220 includes a first lateral support element 264 and a second lateral support element 266 that border the respective lateral sides of bar screen 232. The first lateral support element 264 has an outer end that is attached to the interior surface 224 of vessel wall 222 by welding seams 268 and an inner end that is attached to a first lateral cover plate 270 by welding 272. The second lateral support element 266 has an outer end that is attached to the interior surface 224 of vessel wall 222 by welding 274 and an inner end that is attached to a second lateral cover plate 276 by welding 278.

The bar screen 232 includes a plurality of vertically extending bars 238 having gaps 280 between the bars. In certain preferred embodiments, the bars may be cylindrical and may extend in horizontal or diagonal directions. The bar screen also includes a series of support arches 260A-260K that engage the vertically extending bars 238. Each support arch 260 has a first end 282, a second end 284 and a plurality of fingers 286 that engage the respective bars 238. The fingers 286 define flow channels 288 therebetween that are in communication with the gaps 280 between the bars 238.

The bar screen 232 also includes a first side frame 290 that is attached to the first end 282 of the support arch 260 by welding 292 and second side frame 294 that is attached to the second end 284 of the support arch 260 by welding (not shown). The side frames 290, 294 may be attached to a plurality of the support arches for holding the support arches in a fixed orientation relative to one another. The inner ends of the fingers 286 desirably have grooves 296 formed therein for effectively seating the bars. In the particular embodiment shown, the grooves 296 are concave in shape.

Referring to FIG. 8, the support arch 260 has an outer face 298 that defines an arch and a series of projections 300 extending from the outer face 298. The inner surface 224 of the vessel wall 222 has a radius R3 from centerline C (the position of centerline C is shown for simplicity only and is not to scale). The curvature of the support arch 260 preferably changes between the first and second ends of the arch 260. As shown in FIG. 8, the projections 300A and 300G adjacent the ends of the support arch are in contact with the inner surface 224 of vessel wall 222. However, the gap 302 between the projections 300 and the inner surface 224 increases between the ends of the support arch and the center of the support arch 260. As a result, the gap 302 between projection 300D and inner surface 224 is greater than the gap between projections 300C and 300E and inner surface, which is greater than the gap between projections 300B and 300F and inner surface 224. The radius of the support arch 260 is about R3 at the ends of the arch and is about R4 at an interior section of arch 260, whereby R4<R3.

As shown in FIGS. 8 and 9, the bar screen 232 is not permanently attached to the vessel wall 222, but is able to move relative to the vessel wall 222. As a result, the bar screen is able to move up and down between the upper and lower support elements 240, 242 and laterally between the lateral support elements 264, 266.

Referring to FIGS. 3A and 8, in certain preferred embodiments, the bar screen 232 is assembled by attaching the first and second side frames 290, 294 to the first and second ends of support arches 260. The support arches include top support arch 260A, bottom support arch 260K, and intermediate support arches 260B-260J that lie between the top support arch and the bottom support arch. The support arches 260A-260K extend in directions that are generally parallel to one another. In the particular embodiment shown in FIG. 3A, the support arches are parallel to one another and extend in substantially horizontal directions relative to the length of the digester.

Referring to FIGS. 3A, 8 and 10, the length of the fingers 286 on a single support arch preferably remain the same, however, the finger length may vary between two or more arches. In other words, a first support arch may have fingers with a length x, and a second support arch may have fingers with a length x+1. Referring to FIG. 3A, in certain preferred embodiments, the fingers of support arch 260F are longer than the fingers of support arches 260E and 260G, which are longer than the fingers of support arches 260D and 260H, which are longer than the fingers of support arches 260C and 260I, which are longer than the fingers of support arches 260B and 260J. As a result, when the vertically extending bars 238 are assembled with the support arches, the bars have a slight curve, with the center of the curve being located outside the vessel wall 222. Referring to FIG. 4, the bars 238 are curved about a center located outside the vessel wall and having a radius designated R1. As shown in FIG. 3A, the upper end of the bar screen 232 defines a diameter D1, and the lower end of the bar screen defines a diameter D3 that is equal to D1. The center of the bar screen defines a diameter D2 that is less than D1 and D3. Thus, the inner face of the bar screen 232 has a decreasing diameter between the upper end 234 of the bar screen and a mid-point located between the upper and lower ends, and then has an increasing diameter between the mid-point of the bar screen and the lower end 236 thereof.

In certain preferred embodiments, the lower ends of the bars 238 are permanently attached to the fingers of the bottom support arch 260K and the fingers of the top support arch 260A, and are not permanently attached to the fingers of the intermediate arches 260B-260J. This may be accomplished by seating a lower end of a bar 238 in one of the fingers of the bottom support arch 260K and welding the bar to the finger. The bar is then seated in the fingers of the intermediate arches, starting first with arch 260J and moving onto 260B. The upper end of the bar is then seated in the groove of one of the fingers of top support arch 260A and welded to the finger of the top support arch. The process is repeated for all of the vertically extending bars so that the lower ends of the bars are welded to the bottom support arch and the upper ends of the bars are welded to the top support arch. Due to the changing length of the fingers, the bars will have a slight curve between top and bottom support arches 260A, 260K. In certain preferred embodiments, the bars follow a curve having a center located outside the vessel wall, whereby the curve has a radius R1 of between about 55-70 meters and more preferably about 60-65 meters. Thus, the bars 238 follow a curved path having an extremely large radius.

Figure 11A:
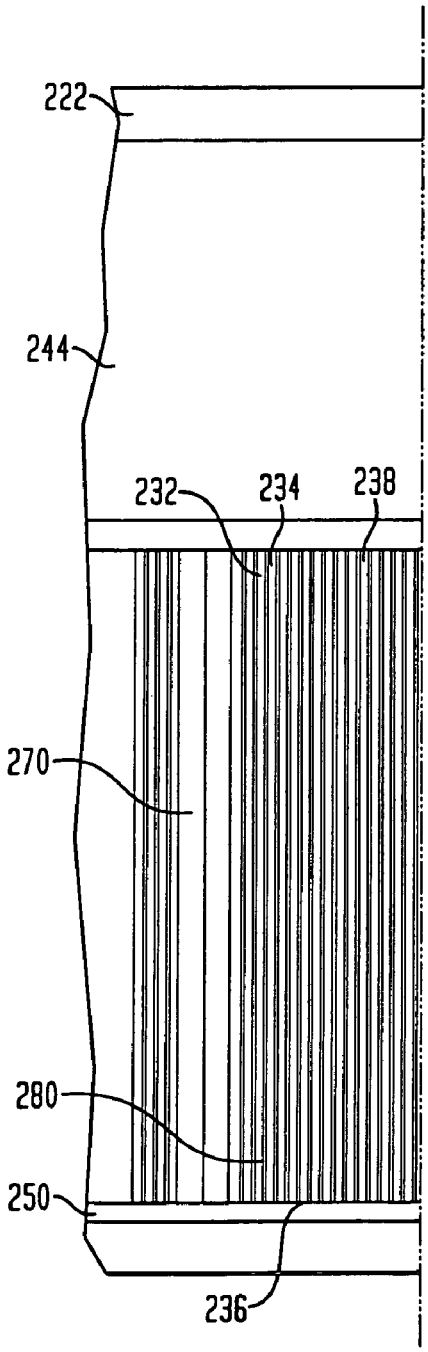
FIG. 11A shows a bar screen having constant gaps between bars, in accordance with certain preferred embodiments of the present invention.

FIG. 11A shows bar screen 232 held in position by upper cover plate 244, lateral cover plate 270, and lower cover plate 250. The bar screen is not permanently affixed to the vessel wall 222 so that the screen is able to float under the cover plates. The bar screen 232 includes a series of vertically extending bars 238 having gaps 280 therebetween. The size of the gaps 280 remains constant between the upper end 234 and the lower end 236 of the screen 232.

Figure 11B:
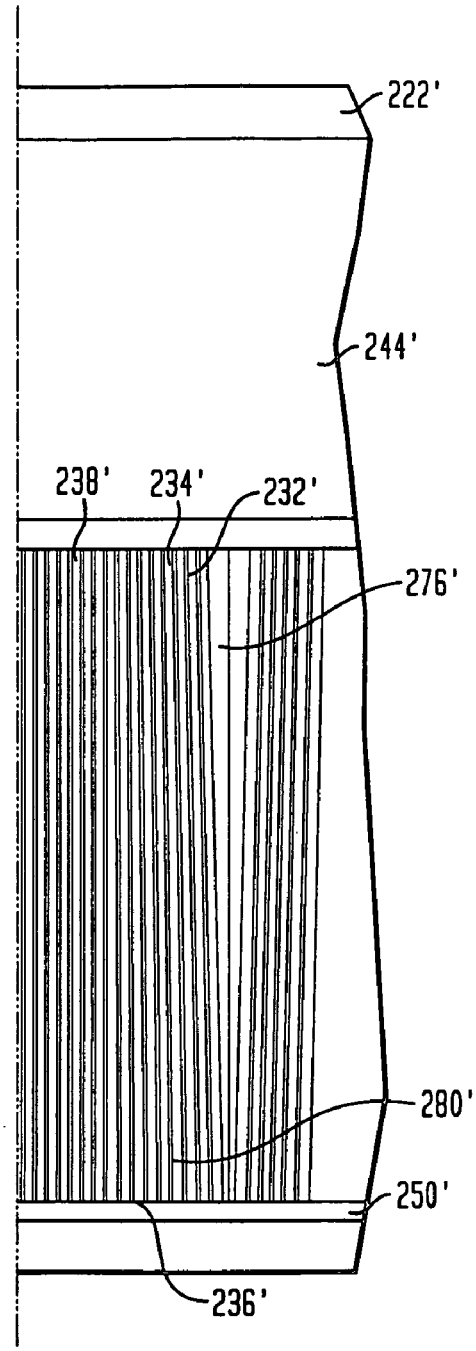
FIG. 11B shows a bar screen having gaps that increase in size between ends of the screen, in accordance with other preferred embodiments of the present invention.

FIG. 11B shows a bar screen 232' held in position by upper cover plate 244', lateral cover plate 276' and lower cover plate 250'. Once again, the bar screen 232' is not permanently affixed to the vessel wall 222', but is able to move relative to vessel wall 222'. The bar screen 232' includes a series of bars 238' having gaps 280' therebetween. The size of the gaps 280' between the bars 238' increases between the upper end 234' and the lower end 236' of the screen 232'.

Figure 1A:
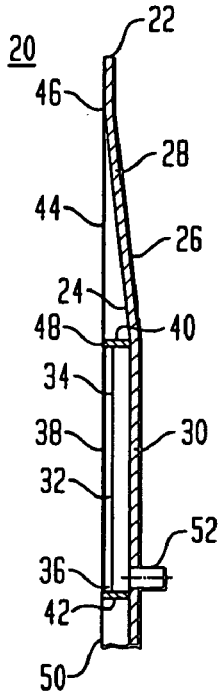
FIG. 1A (PRIOR ART)
FIG. 1A shows a cross-sectional view of a prior art pulp digester including a vessel and a cylindrical screen mounted in the vessel.
Figure 1B:
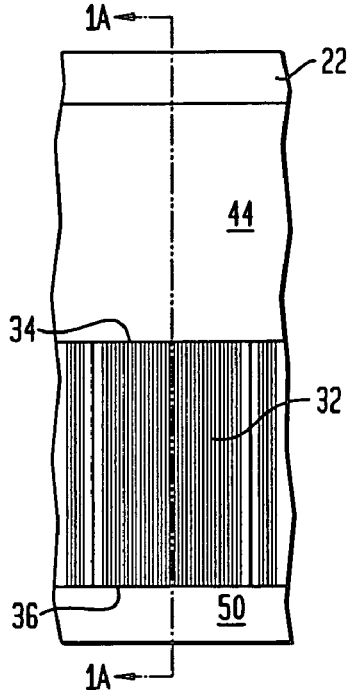
FIG. 1B (PRIOR ART)
FIG. 1B shows a fragmentary front elevation view of the prior art pulp digester of FIG. 1A.
Figure 2A:
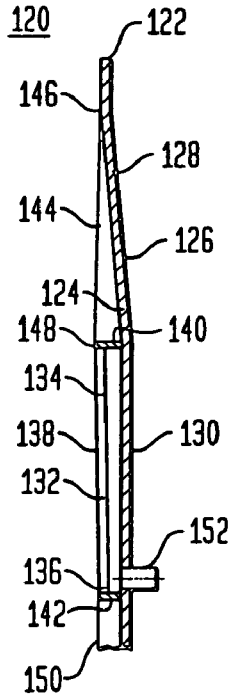
FIG. 2A (PRIOR ART)
FIG. 2A shows a cross-sectional view of a prior art pulp digester including a vessel and a diverging screen mounted in the vessel.
Figure 2B:
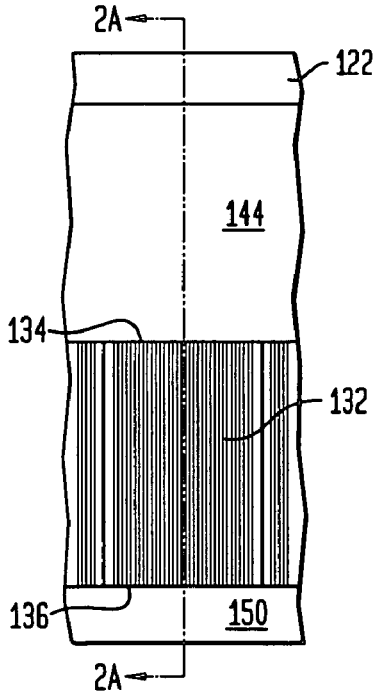
FIG. 2B (PRIOR ART)
FIG. 2B shows a fragmentary front elevation view of the prior art pulp digester of FIG. 2A.
Figure 12:
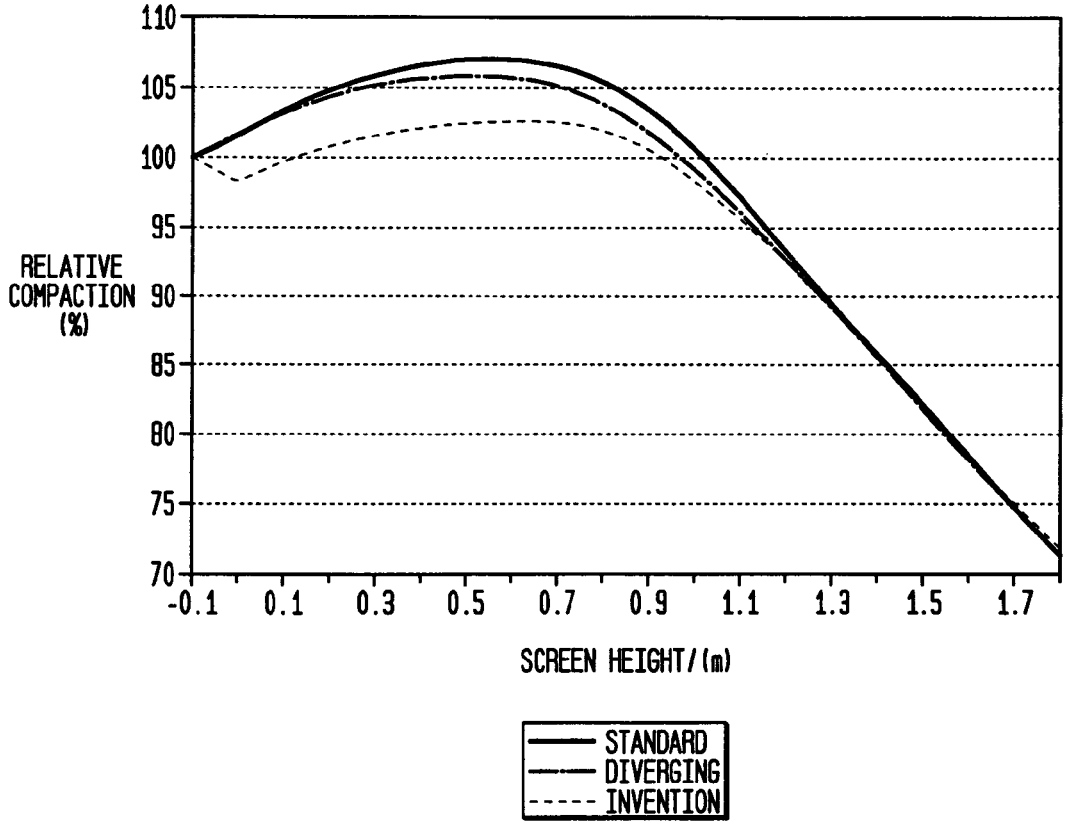
FIG. 12 shows a graph comparing relative chip compaction for a right cylinder screen assembly, a diverging screen assembly and a screen assembly in accordance with certain preferred embodiments of the present invention.

FIG. 12 shows a graph comparing relative chip compaction in a pulp digester when using the standard, right cylinder screen assembly shown in FIG. 1A, the diverging screen assembly shown in FIG. 2A, and the screen assembly in accordance with certain preferred embodiments of the present invention shown in FIGS. 3A-11B. The results for the standard screen are depicted using a solid line, the results for the diverging screen are depicted using a dashed line having elongated dashes, and the results for the screen assembly of the present invention are depicted using a dashed line having shorter dashes. The X-axis in the graph represents the height of the screen assembly, starting 0.1 meter above the screen (wherein the cover plate is located). The Y-axis in the graph shows the relative compaction of the chip column. The chip columns in the three different systems (i.e. standard screen, diverging screen, screen of the present application) all have the same absolute starting value at 0.2 meter above the upper end of the screen. The graph shows that compaction for the standard screen and diverging screen increases at the transition between the cover plate and the screen. In contrast, the compaction level for the present invention actually decreases at the transition because the upper cover plate diverges. The peak value of the compaction is at the location where there is no axial flow vector at all. After peak value, the compaction is decreased rapidly by counter-current wash flow.

Thus, the graph of FIG. 12 shows that the screen assembly of the present invention provides the pressure relief where it is needed: at the top area of the screen. In contrast, the diverging screen has an integrating effect along the screen height. At the beginning there is no effect because of the diverging screen. At the end, where the effect of the diverging screen is greatest, the counter-current wash-flow dramatically reduces the compaction.

These and other variations and combinations of the features discussed above can be utilized without departing from the present invention. Thus, the foregoing description of the preferred embodiments should be taken by way of illustration rather than by way of limitation of the invention as defined by the claims.

The invention claimed is:

1. A screen assembly for a pulp digester comprising:

a top support arch;

a bottom support arch spaced from said top support arch;

at least one intermediate support arch positioned between said top and bottom support arches;

at least one frame member attached to said top support arch, said bottom support arch and said at least one intermediate support arch for maintaining said support arches is a fixed orientation relative to one another;

a plurality of spaced bars extending between said top and bottom support arches, said spaced bars having upper sections permanently attached to said top support arch, lower sections permanently attached to said bottom support arch and intermediate sections in contact with but not permanently attached to said at least one intermediate support arch;

wherein said bars are curved in a vertical direction between the upper and lower sections thereof.

2. The screen assembly as claimed in claim 1, wherein said bars are cylindrical.

3. The screen assembly as claimed in claim 1, wherein said support arches extend in directions that are parallel to one another.

4. A screen assembly for a pulp digester comprising:

a top support arch;

a bottom support arch spaced from said top support arch;

at least one intermediate support arch positioned between said top and bottom support arches;

at least one frame member attached to said top support arch, said bottom support arch and said at least one intermediate support arch for maintaining said support arches is a fixed orientation relative to one another; and a plurality of spaced cylindrical bars extending between said top and bottom support arches, said spaced bars having upper sections permanently attached to said top support arch, lower sections permanently attached to said bottom support arch and intermediate sections in contact with but not permanently attached to said at least one intermediate support arch, and wherein said screen assembly has an inner face that is convex in a vertical direction.

5. A screen assembly for a pulp digester comprising:

a top support arch;

a bottom support arch spaced from said top support arch;

at least one intermediate support arch positioned between said top and bottom support arches;

at least one frame member attached to said top support arch, said bottom support arch and said at least one intermediate support arch for maintaining said support arches is a fixed orientation relative to one another; and a plurality of spaced cylindrical bars extending between said top and bottom support arches, said spaced bars having upper sections permanently attached to said top support arch, lower sections permanently attached to said bottom support arch and intermediate sections in contact with but not permanently attached to said at least one intermediate support arch, and wherein each said support arch has a convex outer face and a concave inner face having fingers that engage said respective bars, wherein the fingers of said at least one intermediate support arch are longer than the fingers of said top and bottom support arches for facilitating curving of said bars when said bars are in contact with said fingers.

6. The screen assembly as claimed in claim 5, wherein the inner ends of said fingers have seating surfaces adapted to receive said bars.

7. The screen assembly as claimed in claim 6, wherein said bars have curved exterior surfaces and said seating surfaces of said fingers are concave for receiving the curved exterior surfaces of said bars.

8. The screen assembly as claimed in claim 5, wherein said at least one intermediate support arch comprises a plurality of intermediate support arches between said top support arch and said bottom support arch, and wherein the fingers of said intermediate support arches are progressively longer for the arches closer to the center of said screen assembly.

* * * * *

UNITED STATES PATENT AND TRADEMARK OFFICE

CERTIFICATE OF CORRECTION

PATENT NO. : 7,736,467 B2
APPLICATION NO. : 11/011520
DATED : June 15, 2010
INVENTOR(S) : Tuomo Nykanen et al.

It is certified that error appears in the above-identified patent and that said Letters Patent is hereby corrected as shown below:

Column 1, line 65, “The” should read --the--.
Column 2, line 44, “pulp making” should read --pulp-making--.
Column 5, line 13, delete “comprising” and insert therefor --comprises--.
Column 5, line 25, delete “is” and insert therefor --in--.
Column 5, line 43, delete “have” (first instance).
Column 9, line 54, “remain” should read --remains--.
Column 11, line 31, delete “is” and insert therefor --in--.
Column 12, line 4, delete “is” and insert therefor --in--.
Column 12, line 22, delete “is” and insert therefor --in--.

Signed and Sealed this
Fourteenth Day of June, 2011

David J. Kappos

David J. Kappos
*Director of the United States Patent and Trademark Office*